US006394101B1

(12) United States Patent
Secreto

(10) Patent No.: US 6,394,101 B1
(45) Date of Patent: May 28, 2002

(54) ADJUSTABLE FLEXIBLE HAIR CURLER

(76) Inventor: Stacey A Secreto, 1931 Fitzgerald St., Philadelphia, PA (US) 19145

( * ) Notice: Subject to any disclaimer, the term of this patent is extended or adjusted under 35 U.S.C. 154(b) by 0 days.

(21) Appl. No.: 09/933,402

(22) Filed: Aug. 20, 2001

(51) Int. Cl.[7] ..... A45D 2/00; A45D 2/14; A45D 2/20

(52) U.S. Cl. ..... 132/222; 132/262; 132/247

(58) Field of Search ..... 132/222, 262, 132/245, 273, 247

(56) References Cited

U.S. PATENT DOCUMENTS 2,407,393 A * 9/1946 Behr ..... 132/262
2,560,267 A * 7/1951 Baker et al. ..... 132/222
3,099,990 A * 8/1963 Chalfin et al. ..... 132/222
3,232,300 A * 2/1966 Fisher ..... 132/222
3,590,829 A * 7/1971 Parisi ..... 132/262
3,713,455 A * 1/1973 Chen et al. ..... 132/222
5,662,128 A * 9/1997 Habibi ..... 132/262
5,692,528 A * 12/1997 Brenn-albertoni ..... 132/247
5,730,161 A * 3/1998 Kohanek ..... 132/262

* cited by examiner

*Primary Examiner*—John J. Wilson
*Assistant Examiner*—Robyn Kieu Doan
(74) *Attorney, Agent, or Firm*—Goldstein Law Offices, P.C.

(57) ABSTRACT

An adjustable flexible hair curler including an elongated flexible strip having a generally rectangular configuration. The strip has long opposed side edges and short opposed end edges. The strip has a front surface and a back surface. The front surface and the back surface each is divided in a wide central section and a pair of narrow side sections. The narrow side sections of the front and back surfaces have corresponding securement means for coupling together when the strip is rolled into a cylindrical orientation.

1 Claim, 2 Drawing Sheets

ADJUSTABLE FLEXIBLE HAIR CURLER

BACKGROUND OF THE INVENTION

The present invention relates to an adjustable flexible hair curler and more particularly pertains to allowing curls and waves to be easily varied in size.

The use of hair accessory devices is known in the prior art. More specifically, hair accessory devices heretofore devised and utilized for the purpose of setting hair are known to consist basically of familiar, expected and obvious structural configurations, notwithstanding the myriad of designs encompassed by the crowded prior art that have been developed for the fulfillment of countless objectives and requirements.

By way of example, U.S. Pat. No. 5,662,128 to Habibi discloses a hair curler comprised of a sheet of flexible material with a Velcro type fastener for adjusting the diameter of the cylinder. U.S. Pat. No. 5,944,029 to Brenner discloses an easily stored hair curler device comprised of a flexible strip capable of coiling into various different diameters. U.S. Pat. No. 6,041,791 to Belmonte discloses a hair setting strip capable of being fastened to itself with a hook and loop fastener. U.S. Pat. No. 2,580,425 to Harveot discloses a hair curler with holes for ventilation.

While these devices fulfill their respective, particular objective and requirements, the aforementioned patents do not describe an adjustable flexible hair curler for allowing curls and waves to be easily varied in size.

In this respect, the adjustable flexible hair curler according to the present invention substantially departs from the conventional concepts and designs of the prior art, and in doing so provides an apparatus primarily developed for the purpose of allowing curls and waves to be easily varied in size.

Therefore, it can be appreciated that there exists a continuing need for a new and improved adjustable flexible hair curler that can be used for allowing curls and waves to be easily varied in size. In this regard, the present invention substantially fulfills this need.

SUMMARY OF THE INVENTION

In the view of the foregoing disadvantages inherent in the known types of hair accessory devices now present in the prior art, the present invention provides an improved adjustable flexible hair curler. As such, the general purpose of the present invention, which will be described subsequently in greater detail, is to provide a new and improved adjustable flexible hair curler that has all the advantages of the prior art and none of the disadvantages.

To attain this, the present invention essentially comprises an elongated flexible strip having a generally rectangular configuration. The strip has long opposed side edges and short opposed end edges. The strip has a front surface and a back surface. The front surface and the back surface each are divided in a wide central section and a pair of narrow side sections. The wide central section of the front surface is defined by hook and loop material. The narrow side sections have a plurality of apertures extending therethrough in a spaced relationship. The narrow side sections of the back surface have a plurality of protrusions extending outwardly therefrom in a spaced relationship. The protrusions are dimensioned for coupling with the apertures when the strip is rolled into a cylindrical orientation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved adjustable flexible hair curler that has all the advantages of the prior art hair accessory devices and none of the disadvantages.

It is another object of the present invention to provide a new and improved adjustable flexible hair curler that may be easily and efficiently manufactured and marketed.

It is a further object of the present invention to provide a new and improved adjustable flexible hair curler that is of durable and reliable construction.

An even further object of the present invention is to provide a new and improved adjustable flexible hair curler that is susceptible of a low cost of manufacture with regard to both materials and labor, and which accordingly is then susceptible of low prices of sale to the consuming public, thereby making such an adjustable flexible hair curler economically available to the buying public.

Even still another object of the present invention is to provide a new and improved adjustable flexible hair curler for allowing curls and waves to be easily varied in size.

Lastly, it is an object of the present invention to provide a new and improved adjustable flexible hair curler including an elongated flexible strip having a generally rectangular configuration. The strip has long opposed side edges and short opposed end edges. The strip has a front surface and a back surface. The front surface and the back surface each is divided in a wide central section and a pair of narrow side sections. The narrow side sections of the front and back surfaces have corresponding securement means for coupling together when the strip is rolled into a cylindrical orientation.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

With reference now to the drawings, and in particular, to figures one through four thereof, the preferred embodiment of the new and improved adjustable flexible hair curler embodying the principles and concepts of the present invention and generally designated by the reference number 10 will be described.

Specifically, it will be noted in the various figures that the device relates to an adjustable flexible hair curler for allowing curls and waves to be easily varied in size.

Figure 2:
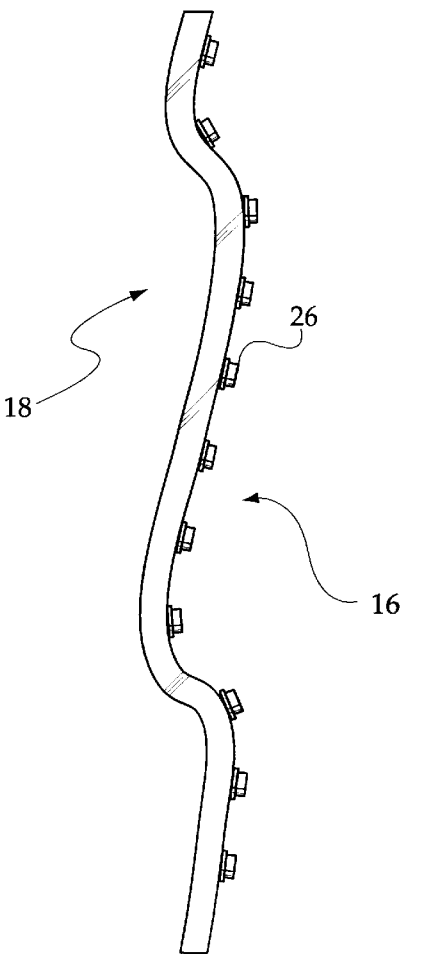
FIG. 2 is a side view of the present.
Figure 1:
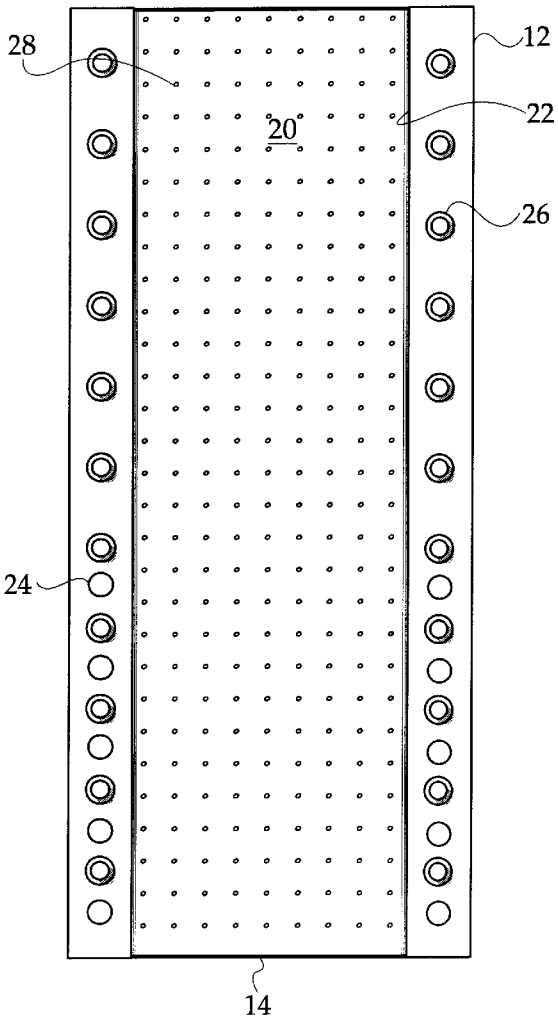
FIG. 1 is a plan view of the preferred embodiment of the adjustable flexible hair curler constructed in accordance with the principles of the present invention.

The present invention is essentially comprised of an elongated flexible strip 10. Note FIG. 1. The elongated flexible strip 10 has a generally rectangular configuration. The strip 10 has long opposed side edges 12 and short opposed end edges 14. The strip 10 has a front surface 16 and a back surface 18. The front surface 16 and the back surface 18 each is divided in a wide central section 20 and a pair of narrow side sections 22. The wide central section 20 of the front surface 16 is defined by hook and loop material. The narrow side sections 22 have a plurality of apertures 24 extending therethrough in a spaced relationship. The narrow side sections 22 of the back surface 18 has a plurality of protrusions 26 extending outwardly therefrom in a spaced relationship. The protrusions 26 are dimensioned for coupling with the apertures 24 when the strip 10 is rolled into a cylindrical orientation. The wide central sections 20 have a plurality of small air holes 28 therethrough. Note FIG. 2.

Figure 3:
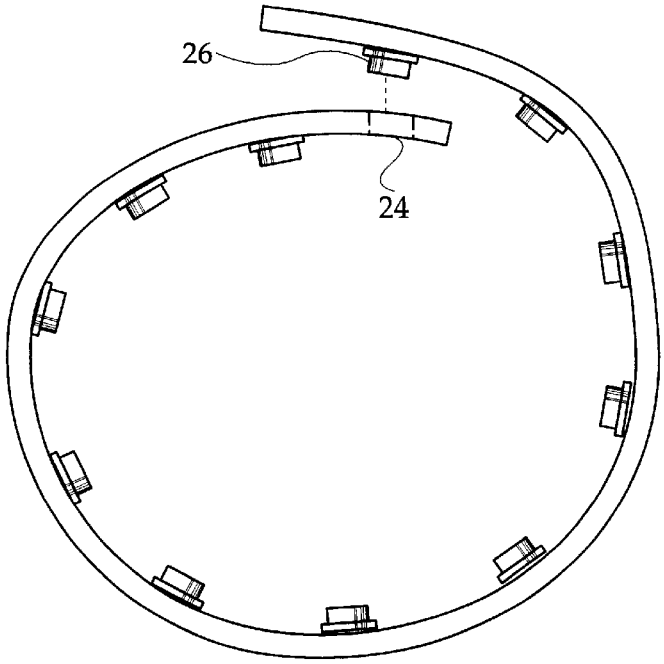
FIG. 3 is a side view of the present invention illustrated in a rolled orientation.
Figure 4:
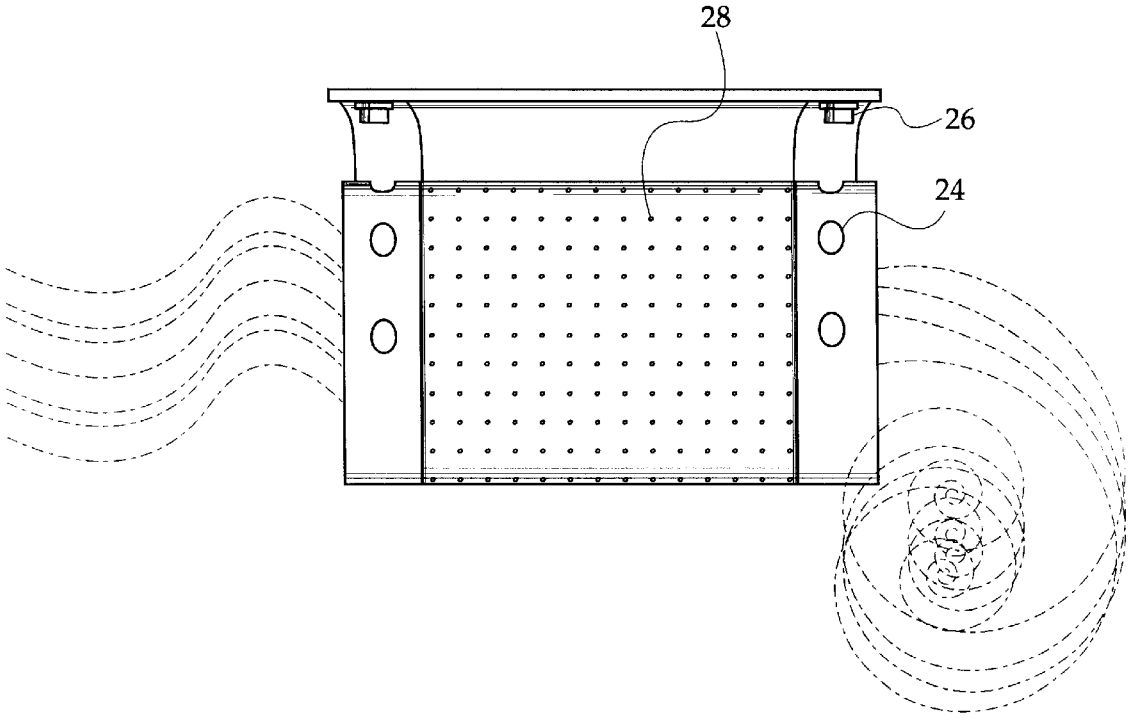
FIG. 4 is a front view of the present invention illustrated in use.

The strip 10 can be rolled into a cylindrical orientation to resemble a hair roller. The plurality of apertures 24 and protrusions 26 allow the strip 10 to be rolled into cylinders of varying diameters that will allow a person using the present invention to style their hair in different sized curls and waves without having to buy numerous sets of curlers. The hook and loop material that constitutes the wide central section 20 of the front surface will help to hold the hair in place against the cylinders. The air holes 28 will allow the heat created by a hair dryer to pass therethrough to dry the hair. Note FIGS. 3 and 4.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An adjustable flexible hair curler for allowing curls and waves to be easily varied in size comprising, in combination:

an elongated flexible strip having a generally rectangular configuration, the strip having long opposed side edges and short opposed end edges, the strip having a front surface and a back surface, the front surface and the back surface each being divided in a wide central section and a pair of narrow side sections, the wide central section of the front surface being defined by hook and loop material, the narrow side sections having a plurality of apertures extending therethrough in a spaced relationship, the narrow side sections of the back surface having a plurality of protrusions extending outwardly therefrom in a spaced relationship, the protrusions being dimensioned for coupling with the apertures when the strip is rolled into a cylindrical orientation, the wide central sections having a plurality of small air holes therethrough.

* * * * *